US005622297A

United States Patent [19]

Rogers et al.

[11] Patent Number: 5,622,297

[45] Date of Patent: Apr. 22, 1997

[54] ADJUSTABLE HANDGUN HOLSTER

[75] Inventors: William H. Rogers; Norman E. Clifton, Jr., both of Jacksonville, Fla.

[73] Assignee: Safariland Ltd., Inc., Ontario, Calif.

[21] Appl. No.: 508,634

[22] Filed: Jul. 28, 1995

[51] Int. Cl.[6] ..... F41C 33/02

[52] U.S. Cl. ..... 224/243; 224/192; 224/911; 224/912; 224/624; 224/627; 206/317; 267/74

[58] Field of Search ..... 224/191, 192, 224/193, 197, 198, 242, 243, 244, 911, 912, 600, 616, 623, 624, 627; 206/317; 211/64; 267/69, 73, 74

[56] References Cited

U.S. PATENT DOCUMENTS

| | | | |
|---|---|---|---|
| 798,529 | 8/1905 | Patrick | 267/74 |
| 1,236,797 | 8/1917 | White | 267/74 |
| 1,421,578 | 7/1922 | Schussler | 224/243 |
| 3,329,278 | 7/1967 | Pachmayr | 206/317 |
| 3,575,404 | 4/1971 | Wesch | 267/74 |
| 4,346,827 | 8/1982 | Bianchi et al. | 224/911 |
| 4,721,238 | 1/1988 | Shoemaker | 224/911 |
| 5,246,153 | 9/1993 | Beletsky | 224/911 |
| 5,358,160 | 10/1994 | Bianchi | 224/911 |
| 5,421,497 | 6/1995 | Gilmore | 224/198 |
| 5,467,909 | 11/1995 | Resca | 224/193 |

*Primary Examiner*—Henry J. Recla
*Assistant Examiner*—Gregory M. Vidovich
*Attorney, Agent, or Firm*—Arthur G. Yeager

[57] ABSTRACT

The holster includes two opposing barrel support strips adjustable in length and joined together at their forward ends through two over-lapping right angle legs adjustable in width and joined together by a selectively releasable connector to form a muzzle stop, and joined together at their rearward ends by a length of a sheath enclosed coil spring adapted to encircle the hand grip and to bias the barrel toward the muzzle stop. The two barrel support strips each have a forward portion and a rearward portion joined together by selectively releasable connectors and adjustable in length through a plurality of aligned holes on at least one portion. The holster includes a plurality of eyes to facilitate attachment to a shoulder harness.

21 Claims, 3 Drawing Sheets

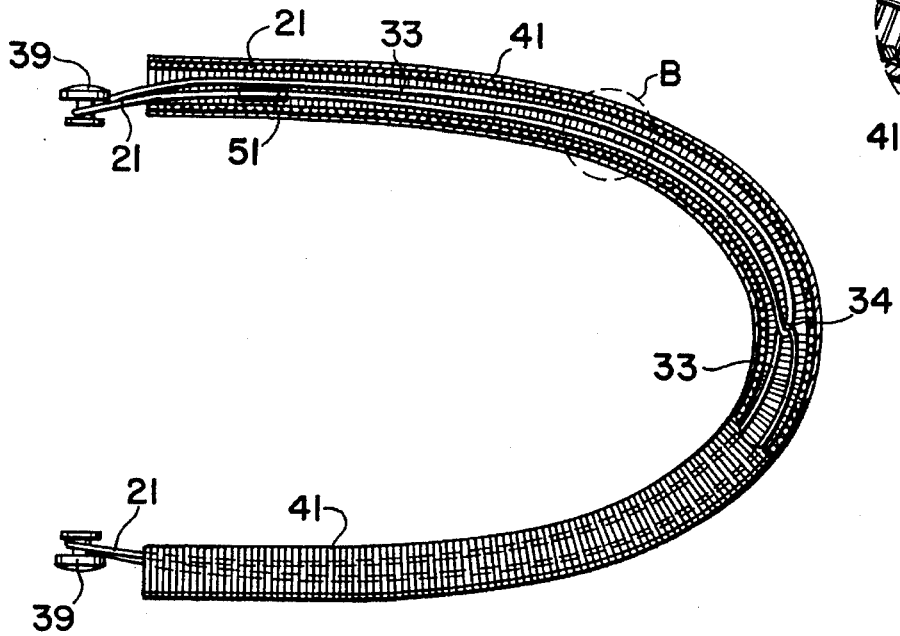
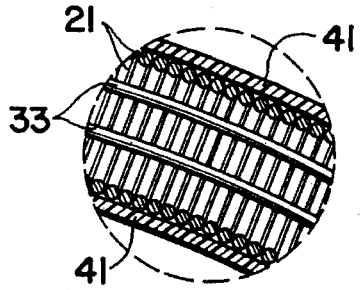
FIG 8B
FIG 8A
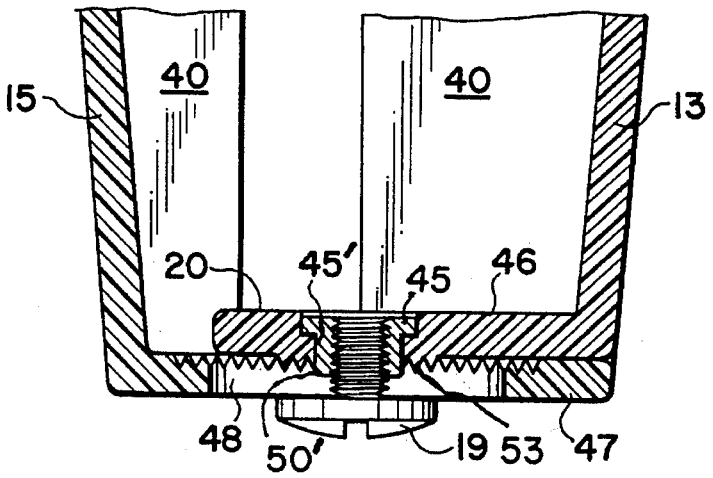
FIG 7

ADJUSTABLE HANDGUN HOLSTER

BACKGROUND OF THE INVENTION

1. Technical Field

This invention relates to holsters for handguns, and particularly to holsters in which the length and the width of the holster may be adjusted.

2. Description of the Prior Art

Holsters for law enforcement officers are found in many styles and designs to fit the desires of all sizes and shapes of individuals and their preferences for where their handguns are to be carried on their bodies. In many instances these guns are carried under the outer layer of clothing so as to be hidden from view. Such inside holsters tend to be reduced to their bare essentials so as to be less bulky and lighter in weight.

A particularly pertinent holster of the inside type is that described and claimed in U.S. Pat. No. 5,358,160 granted Oct. 25, 1994 to John E. Bianchi. Improvements have now been made upon the holster of such U.S. Patent.

It is an object of the invention to provide a novel holster for a pistol for use with a shoulder harness. Another object is to provide a holster that can be adjusted for different types and sizes of pistols in length and in width and adapted for use with a shoulder harness. Still other objects will become apparent from the more detailed description which follows.

BRIEF SUMMARY OF THE INVENTION

This invention relates to an underarm handgun holster having two opposing barrel support members adapted to lie along the two opposite sides of the pistol barrel from the muzzle to the trigger guard. Each support member has a forward portion and a rearward portion joined together by a fastener passing through aligned passageways in the two portions, so as to permit adjustment of the length of the barrel support members. One support member includes a muzzle stop extending transversely across the muzzle end of the forward portions. An elongated coil spring is attached at each of its ends to the two member rearward portions, respectively, and is adapted to urge the pistol forward against the muzzle stop. Upwardly extending eyes on both of the rearward portions are attached to a strap connecting the holster to a body harness.

In one of the preferred embodiments of the invention the coil spring, which assists in retaining the handgun in the holster, is restricted in the amount it can stretch by reason of a wire loop placed inside the coil spring. Also, a non-marring sheath is located about the coil spring to protect the handgun. In another preferred embodiment the holster is adjustable with respect to the girth of the handgun at its muzzle. Also, external muzzle supports improve the holster capability of easy withdrawal of the handgun yet a firm gripping of the muzzle while holstered and self centering thereof. In still another embodiment of the invention the holster has eyes on the lower portions of the holster for fastening it to a waist belt when the holster is in an underarm position.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

FIG. 7 is an enlarged cross-sectional partial view taken along line 7—7 of FIG. 3; and FIG. 8A is an enlarged perspective view of the coil spring of this invention, partially broken away for clarity; and FIG. 8B is another enlargement at the broken line position B of FIG. 8A.

DETAILED DESCRIPTION OF THE INVENTION

The features and advantages of this invention are best understood by reference to the attached drawing with numeral references to various components.

The adjustable holster of this invention is specifically preferred for carrying a handgun in an underarm location covered by an outer garment, such as a jacket, coat, blouse, shirt, or the like. In FIGS. 1–5 and 7, the structure of the holster is shown, and in FIG. 6, there is shown the way in which the holster and its pistol are worn on the body.

Figure 2:
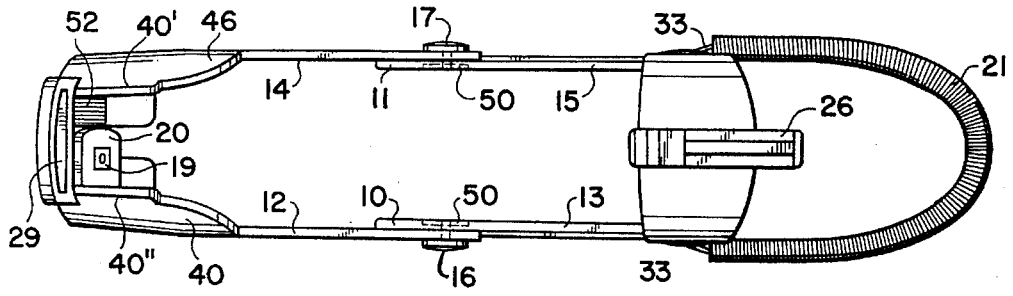
FIG. 2 is a top plan view of the holster of FIG. 1.
Figure 1:
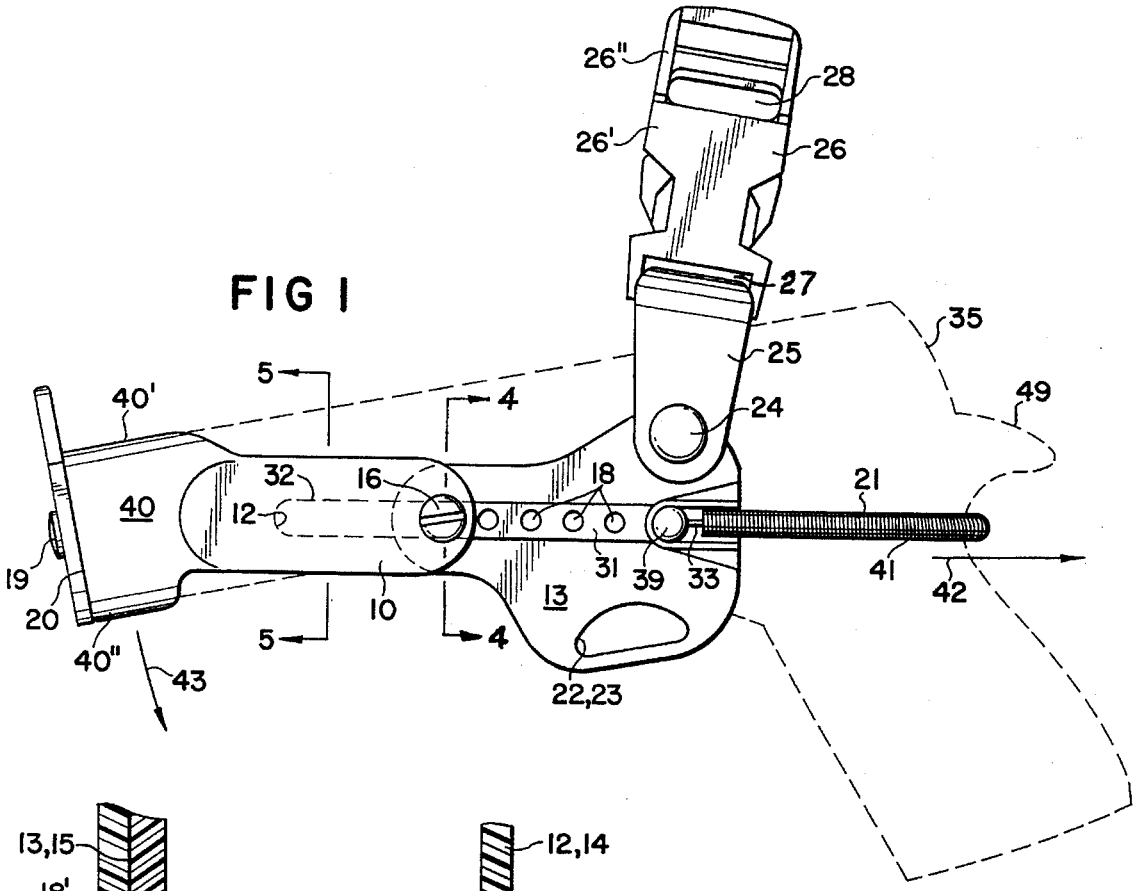
FIG. 1 is a side elevational view of the holster of this invention, a handgun being shown in broken lines.
Figure 4:
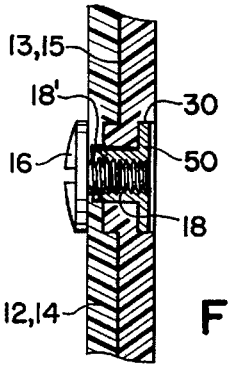
FIG. 4 is a partial cross-sectional view taken along line 4—4 of FIG. 1.
Figure 5:
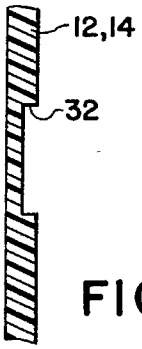
FIG. 5 is a partial cross-sectional view taken along line 5—5 of FIG. 1.
Figure 3:
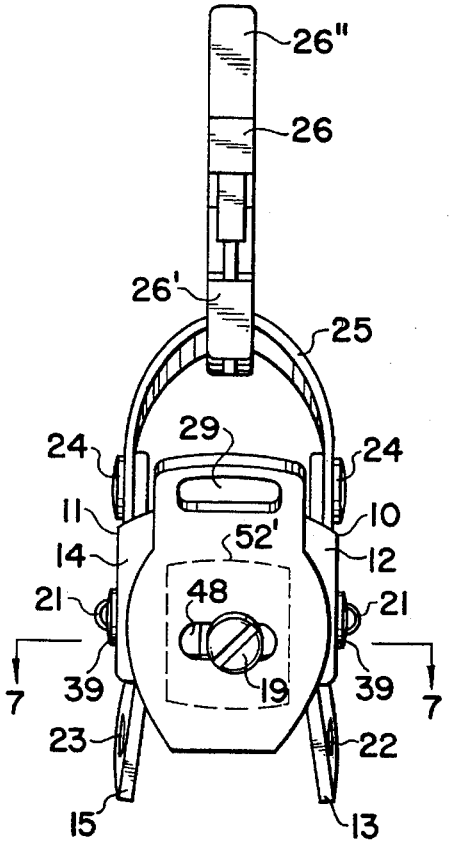
FIG. 3 is a front elevational view of the holster of FIG. 1.

In FIGS. 1–3 there may be seen two barrel support members 10 and 11, which lie along the inside and outside of the barrel of pistol 35 (shown in broken lines in FIG. 1). The terms "inside" and "outside" are intended to refer, respectively to facing the body and facing away from the body of the wearer. In the drawings the wearer is assumed to be right-handed, but it is to be understood that the holster of this invention is equally usable by left-handed as well as right-handed wearers. The forward end of the holster includes a muzzle stop 20 which joins inside barrel support member 10 to outside barrel support member 11. The rearward end of the holster is a length of a coil spring 21 fastened at each of its ends, respectively, to a rivet 39 at the rearward ends of inside barrel support member 10 and outside barrel support member 11. With spring 21 looped around the butt of handgun 35 and the muzzle of the gun pressed against muzzle stop 20, it may be seen that pistol 35 is securely contained in the holster. The two barrel support members are substantially mirror images of each other.

At the forward end of the holster, which preferably is made of a molded tough plastic material, the barrel support members 10 and 11 are curved to form muzzle supports 40 that partially encircle the muzzle of the pistol. Each muzzle support 40 includes a shoulder 46 or 47 (see FIG. 7), that are bent toward each other at right angles to their respective muzzle supports 40, and overlap each other to form muzzle stop 20. One shoulder (47 in FIG. 7) is punctured by a horizontal slot 48 while the other shoulder (46 in FIG. 7) is punctured by a hole 45' through which the shank of a releasable connector in the form of a screw 19 extends to a square nut 45 which is countersunk into shoulder 46. The square nut 45 includes a round sleeve 50' which extends through the hole 45' and terminates between the inner and outer surfaces of shoulder 47. This arrangement permits the contraction or the enlargement of the internal space between muzzle supports 40 by use of a screwdriver on screw 19. As shown more specifically in FIG. 7, the outer face of shoulder 46 contains a plurality of spaced protrusions 53 which surround hole 45' and extend generally vertically, i.e., parallel to a vertical plane extending through the longitudinal centerline between the support members 10 and 11. Complemental grooves 52 (seen also in FIG. 2) are provided in the face of shoulder 47 and extend vertically throughout the area represented by broken lines 52' of FIG. 3 and surrounding slot 48. The protrusions 53 and grooves 52 are generally V-shaped, i.e., a cross-sectional shape of a triangle and are complemental. As seen in FIG. 7, the outer face of shoulder 46 is juxtaposed to inner face of shoulder 47 when the protrusions 53 and grooves 52 intermesh. Therefore, when a user adjusts the width between the support members 10 and 11, the protrusions 53 and grooves 52 maintain the support members 10 and 11 parallel to the grooves 52 and protrusions 53 and substantially parallel to each other. This adjustment allows the muzzle of the holster to expand or contract to provide a more exacting fit onto the different types and configurations of pistol muzzles and also a close fit or a loose fit around the muzzle of a pistol in the holster. Shoulder 47 also contains eye 29 (see FIG. 3) which functions as an attachment for a keeper strap to connect the muzzle end of the holster to a shoulder harness 37 by a loop or snap hook 37' (see FIG. 6). Also, by having two muzzle supports 40 each having two spaced shoulders 40' and 40", the shoulders provide a self-centering capability to the muzzle of the handgun while it is being holstered.

In order to provide an adjustment capability to accommodate guns of different length, each barrel supporting member 10 and 11 is divided into forward and rearward portions joined by releasable fastener 16. Barrel supporting member 10 and 11 have respective forward portions 12 and 14 and rearward portions 13 and 15. Fasteners 16 (one for each barrel supporting members 10 and 11) preferably comprise a bolt 16 and a nut 50 on the outside and inside surfaces respectively, of each barrel supporting member 10 and 11. In order to prevent scratching or marring of the gun surfaces the nut 50 is countersunk in a groove 30 in the inside surfaces of barrel supporting members 10 and 11.

In order to keep forward portions 12 and 14 aligned with respective rearward portions 13 and 15 throughout the length adjustment of barrel supporting members 10 and 11, the forward and rearward portions 12, 13, 14 and 15 are provided with a tongue-and-groove engagement. This may best be seen in FIGS. 1,4, and 5. The rearward portions 13 and 15 of each barrel supporting member 10 and 11 are fashioned with a lengthwise tongue 31 on the outside surface. The forward portions 12 and 14 of each barrel supporting member 10 and 11 is provided with a longitudinal groove 32 to fit snugly with tongue 31. Tongue 31 is also provided with a plurality of closely spaced holes or passageways 18, while groove 32 has one such hole or passageway 18' shown in FIG. 4, through which bolt 16 extends its threaded shank within round sleeve to the internal square nut 50 caged by and recessed within groove 32. This combination of holes or passageways 18 with bolt 16 provides the capability of lengthening or shortening the overall length of the holster.

Figure 6:
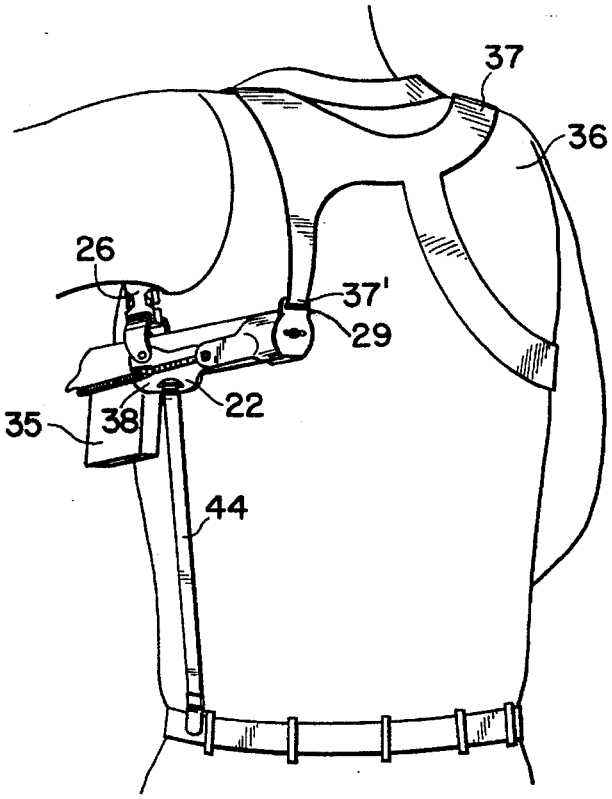
FIG. 6 is a schematic perspective view of an individual wearing a shoulder harness and the holster of this invention in an underarm position.

Each rearward portion 13 and 15 also preferably includes an eye 22 or 23 adapted to provide an attachment position for a strap 44 to extend to a waistbelt of the wearer 36 as shown in FIG. 6. It is, of course, contemplated that the lower connection of strap 44 might be a suspender clip to be attached to the top of the pants instead of a waist belt. Only one of eyes 22 and 23 is expected to be used at any one time, that being the eye of the rearward portion 13 or 15, which is next to the body of the wearer. This provides for both right-handed and left-handed wearers.

Attached to the top of rear portions 13 and 15 is a length of flexible strap 25, preferably leather or a leather substitute fastened at each of its ends, respectively, to rear portions 13 and 15 to button rivets 24. The connection between rivets 24 and rearward portions 13 and 15 is sufficiently loose to permit strap 25 to pivot about rivets 24. Strap 25 is attached to any convenient coupling that can be attached to a shoulder harness. A preferred coupling is a quick release bayonet coupling 26 having a female portion 26' and a male portion 26", having an eye 27 to allow strap 25 to pass through, and an eye 28 to permit attachment to a shoulder harness. (See U.S. Pat. Nos. 4,150,464 and 4,171,555 for such a coupling 26) The sliding connection between coupling 26 and strap 25 as well as the pivotal connection of strap 25 to rear portion 13 or 15 allows the holster to automatically position itself to any body wearing a shoulder harness.

The coil spring 21 is a feature of this invention and is shown in FIGS. 1, 2 and more specifically in FIGS. 8A and 8B. The spring 21 restrains the pistol from falling out of the holster without need for a strap or flap on the holster. Spring 21 is a length (perhaps 3–4 inches) of a tightly coiled spring fastened at each end to rearward portions 13 and 15, respectively, by way of a rivet 39, or other equivalent fastener. Spring 21 is expected to loop around the butt of pistol 35 (see FIG. 1) at the top of the hand grips where there is a curved projection 49 that fits between the thumb and index finger of the hand. Spring 21 is of a size to provide a bias to the pistol urging it forward into the holster against muzzle stop 20. Because a metal-to-metal contact of the bare metal spring 21 against the rear of the gun might produce undesirable scratching or marring, spring 21 is preferably covered with a plastic sheath 41 (see FIG. 7). Another preferred feature is to include a restraint to prevent extension of spring 21 beyond a selected amount. This feature is preferred because it is a safeguard against a deforming overstretching of the spring beyond its ability to return to its non-stretched condition. This restraint can be provided by including a predetermined length of wire inside the coil 21 and connected to the same terminal rivets 39. An especially desirable arrangement is to employ two long loops of wire 33, each tied to respective rivets 39, and with the two loops 33 being interconnected as at 34. The ends of each wire 33 may be connected by a crimping connector 51, for example.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. An adjustable handgun holster comprising two opposing barrel support members adapted to lie along opposite sides of a handgun barrel from its muzzle to its trigger guard, each support member having a forward portion and a rearward portion, means for joining together said forward and rearward portion of each said support member for adjusting the length of said support members, one said support member adjacent said forward portion including a muzzle stop adapted to extend transversely across a muzzle end of a handgun, an elongated coil spring attached at each end to said rearward portions, respectively, and adapted to bias a handgun forwardly against said muzzle stop, an upwardly extending eye means attached to both said rearward portions and adapted to receive a strap connecting said holster to a body harness supporting said holster, and a downwardly extending eye means in one said rearward portion adapted to receive a strap therethrough for connecting said holster to a portion of a wearer's clothing below said holster.

2. The holster of claim 1 which additionally comprises another downwardly extending eye means in the other said rearward portion adapted to receive a strap therethrough for connecting said holster to a portion of a wearer's clothing below said holster.

3. The holster of claim 1 wherein said elongated coil spring includes means to limit the elongation of said coil spring to a predetermined limit.

4. The holster of claim 3 wherein said means to limit includes a fixed length of wire extending through an internal hollow of said coil spring to an attachment at each end thereof to respective said rearward portions of said support members.

5. The holster of claim 3 further comprising a non-marring protective sheath about said coil spring to protect a handgun being holstered in said holster.

6. The holster of claim 1 wherein said forward portions at their ends adjacent a muzzle of a handgun include spaced shoulders which are adapted to engage a muzzle of a handgun being holstered and causing same to be self-centered by said shoulders.

7. The holster of claim 1 wherein each said means for joining includes a bolt and a nut, each said support member forward portion at its rearward end is pierced with a single hole of a size to receive a shank of said bolt therethrough, and each said support member rearward portion has a plurality of spaced holes of the same size as said hole in said forward portion to receive said shank of said bolt, and a longitudinal groove on an inside surface of said rearward end aligned with said plurality of holes, said groove receiving and preventing rotation of said nut and dispose said nut below said inside surface of said rearward portion.

8. An adjustable handgun holster comprising two opposing barrel support members adapted to lie along opposite sides of a handgun barrel from its muzzle to its trigger guard, each support member having a forward portion and a rearward portion, means for joining together said forward and rearward portions of each said support member, one said support member adjacent said forward portion including a muzzle stop adapted to extend transversely across a muzzle end of a handgun, an elongated coil spring attached at each end to said rearward portions, respectively, and adapted to bias a handgun forwardly against said muzzle stop, an upwardly extending eye means attached to both said rearward portions and adapted to receive a strap connecting said holster to a body harness supporting said holster, said forward portions including generally semi-cylindrical shapes at their ends adjacent a muzzle of a handgun, each said end of each said forward portion having an inwardly extending, mutually overlapping tab, integral with said respective support member, and releasable means for connecting said tabs together.

9. An adjustable handgun holster comprising two opposing barrel support members adapted to lie along opposite sides of a handgun barrel from its muzzle to its trigger guard, each support member having a forward portion and a rearward portion, means for joining together said forward and rearward portions of each said support member, one said support member adjacent said forward portion including a muzzle stop extending transversely across a muzzle end of a handgun, an elongated coil spring attached at each end to said rearward portions, respectively, and adapted to bias a handgun forwardly against said muzzle stop, an upwardly extending eye means attached to both said rearward portions and adapted to receive a strap connecting said holster to a body harness supporting said holster, said forward portions including inturned flange ends adjacent an end of a muzzle of a handgun, said muzzle stop being formed by one said inturned flange, another said inturned flange being located outwardly of said one inturned flange and having a slot therethrough extending generally in a horizontal direction between said barrel support members, said one inturned flange having an opening therein aligned with said slot, and releasable means passing through said slot and opening for adjustably connecting said forward portions together at various selected widths of muzzles of handguns to be holstered in said holster.

10. The holster of claim 9 wherein said releasable means includes a threaded nut engaged with said one inturned flange and a bolt threaded on said nut and engaged with said another inturned flange.

11. The holster of claim 9 wherein said inturned flanges include vertically extending complemental grooves and protrusions for maintaining said barrel support members substantially parallel at any selected width therebetween.

12. The holster of claim 11 wherein said grooves and said protrusions are substantially V-shaped, said grooves surrounding and being substantially perpendicular to a horizontal axis of said slot, said protrusions being located to surround said opening.

13. An adjustable handgun holster comprising two elongated opposing barrel support members each having a forward portion and a rearward portion, said support members being adapted to lie along opposite portions of a handgun barrel, each said forward portion including an inturned flange adjacent an end of a muzzle of a handgun, a first said inturned flange forming a muzzle stop, a second said inturned flange being located outwardly of said first inturned flange, one of said inturned flanges having a slot therethrough, another of said inturned flanges having an opening therein aligned with said slot, and releasable means passing through said slot and opening for adjustably connecting said forward portions together at various selected sizes of muzzles of handguns to be holstered in said holster.

14. The holster of claim 13 wherein said forward portions at their ends adjacent a muzzle of a handgun include spaced shoulders which are adapted to engage a muzzle of a handgun being holstered and causing same to be self-centered by said shoulders.

15. The holster of claim 13 wherein said releasable means includes a threaded nut engaged with said first inturned flange and a bolt threaded on said nut and engaged with said second inturned flange.

16. The holster of claim 13 wherein said inturned flanges include vertically extending complemental grooves and protrusions for maintaining said barrel support members substantially parallel at any selected width therebetween.

17. An underarm handgun holster of stiff molded plastic material comprising two elongated barrel side support members, transverse overlapping tabs extending toward each other at a muzzle end of said support members, releasable means for transversely adjusting said tabs to generally conform said barrel support members about a muzzle of a handgun, said barrel support members having an elongated forward portion and an elongated rearward portion, a forward end of each said rearward portion having a plurality of longitudinally spaced holes, a rearward end of each said forward portion having a hole aligned with any one of said plurality of spaced holes in said rearward portion, releasable means for securing said aligned holes together to provide an adjustable length to said support members to accommodate various lengths of handguns, an elongated coil spring having opposite ends attached to a rearward end respectively of said rearward portions to form a rearwardly extending loop adapted to fit around a grip of a handgun and bias same forward into engagement with one of said tabs.

18. The holster of claim 17 further comprising a transverse strap pivotally attached at each end thereof to said rearward portions, a slidable member on said strap with an upwardly projecting eye; and a second and third eye respectively on each said rearward portion adapted to receive a connecting strap in one said second and third eyes to extend downwardly from said holster to anchor to clothing of a wearer.

19. The holster of claim 17 wherein each said means for joining includes a bolt and a nut, each said support member forward portion at its rearward end is pierced with a single hole of a size to receive a shank of said bolt therethrough, and each said support member rearward portion has a plurality of spaced holes of the same size as said hole in said forward portion to receive said shank of said bolt, and a longitudinal groove on an inside surface of said rearward end aligned with said plurality of holes, said groove receiving and preventing rotation of said nut and dispose said nut below said inside surface of said rearward portion.

20. The holster of claim 17 wherein said inturned flanges include vertically extending complemental grooves and protrusions for maintaining said barrel support members substantially parallel at any selected width therebetween.

21. The holster of claim 17 further comprising an internal wire member located within said coil spring to restrict the elongation of said spring to a length of said wire member, and a protective sheath about said coil spring.

* * * * *